United States Patent [19]

Gruber et al.

[11] Patent Number: 4,487,825

[45] Date of Patent: Dec. 11, 1984

[54] CONDUCTIVE SINGLE COMPONENT ELECTROPHOTOGRAPHIC MAGNETIC TONER

[75] Inventors: Robert J. Gruber, Pittsford; John F. Knapp, Fairport, both of N.Y.

[73] Assignee: Xerox Corporation, Stamford, Conn.

[21] Appl. No.: 227,003

[22] Filed: Jan. 22, 1981

[51] Int. Cl.[3] ..... G03G 9/14

[52] U.S. Cl. ..... 430/106.6; 430/903; 430/107

[58] Field of Search ..... 430/107, 98, 109, 903

[56] References Cited

U.S. PATENT DOCUMENTS

| | | | |
|---|---|---|---|
| 2,846,333 | 8/1958 | Wilson | 117/17.5 |
| 3,293,059 | 12/1966 | Stowell | 430/98 |
| 3,377,286 | 8/1968 | Stricklin | 430/107 X |
| 3,590,000 | 6/1979 | Palermiti | 252/62.1 |
| 3,639,245 | 2/1972 | Nelson | 430/110 X |
| 3,787,877 | 1/1974 | Nacci et al. | 346/74 |
| 3,985,664 | 10/1976 | Sakaguchi et al. | 430/109 |
| 4,031,021 | 6/1977 | Deming | 252/62.1 |
| 4,108,786 | 8/1978 | Takayama et al. | 252/62.1 |
| 4,137,188 | 1/1979 | Vetake et al. | 430/111 |
| 4,161,453 | 7/1979 | Gilliams et al. | 430/115 |

FOREIGN PATENT DOCUMENTS

| | | | |
|---|---|---|---|
| 2754994 | 6/1978 | Fed. Rep. of Germany | 430/106.6 |

*Primary Examiner*—John D. Welsh
*Attorney, Agent, or Firm*—Palazzo E. O.

[57] ABSTRACT

This invention relates to a conductive single component magnetic dry toner comprised of resins selected from polystyrene allyl alcohol copolymers, and epoxy resins, a magnetic material such as magnetite, and a conductive carbon black which is adhered and/or embedded on the surface of the copolymer or epoxy resin-magnetic material mixture. Such toner compositions, which have excellent conductivity, superior flow properties and low melt fusing temperatures, 95° C.–130° C., are useful for causing the development of images in commercial printers and recorders such as the Versatec printers.

3 Claims, No Drawings

CONDUCTIVE SINGLE COMPONENT ELECTROPHOTOGRAPHIC MAGNETIC TONER

BACKGROUND OF THE INVENTION

This invention relates generally to single component developers, and more specifically to single component conductive toners containing magnetic materials, which toners are useful for example in the production of high quality images in electrophotographic systems, and in various other imaging systems including commercial printing machines, such as Versatec printers. The toner compositions of the present invention are unique in that for example lowenergy outputs can be employed for causing the fusing of said compositions to a substrate, which fusing can be accomplished subsequent to the application of the toner composition to the image, and transfer of the development image to a substrate, such as paper.

The production and development of images, particularly xerographic latent images is well known and is described in many prior art publications and patents. In one development sequence, there is employed developer materials such as toner, which when blended with a suitable carrier is referred to as the developer composition. Subsequent to development, the latent image can be transferred from the photoconductive surface, such as selenium, to a suitable substrate such as paper and thereafter fixed or fused to the paper substrate. Various fixing methods can be employed including vapor fixing, heat fixing, pressure fixing or combinations thereof, as described for example in U.S. 3,539,161. Many methods are known for applying the toner to the latent photoreceptor image including cascade development, magnetic brush development, powder cloud development and the like. In the magnetic brush system, magnetically manageable carrier particles are employed. In this system a magnetic force is used to provide adherence of the developer (carrier and toner) to a support member, which is then presented to the image bearing member. Magnetic brush development fills in solid areas, in very well compacted and does not depend on gravity to present the toner to the latent image bearing surface, as is necessary with free flowing cascade development, a factor which allows freedom in locating the developer station.

There are also known systems for magnetic development wherein the carrier material is not utilized, one such system being described in U.S. Pat. No. 2,846,333. This patent teaches the use of a magnetic brush to apply toner particles formed of ferrites and resin material to develop electrostatic latent images. One difficulty encountered with the process is that the conductivity of the toner renders electrostatic transfer rather difficult. However, such processes have been used commercially when special papers are employed, such as coated papers like zinc oxide paper.

A further development system using magnetic development is illustrated in U.S. Pat. No. 3,909,258 wherein an electrostatic development process utilizing a magnetic brush without carrier is illustrated. A toner suitable for use in this process is disclosed in U.S. Pat. No. 3,639,245, (Nelson) wherein a dry toner powder having specific electric conductivity is disclosed. The toner of this patent is formed by blending magnetite with a resin, and subsequently pulverizing the resulting material to a small particle size. The resulting particles are then mixed with carbon black, and small particle size silicon dioxide particles to improve flowability.

In another form of development of electrostatic charge patterns, there is employed a conductive one component toner which is contained on a conductive support member, and is brought into contact with the charge pattern bearing member as described in U.S. Pat. No. 3,166,432. In this situation the toner particles are held to the support member by Vanderwaals forces, and the conductive support member is held at a bias potential during development. This technique is particularly adaptable to solid area coverage and further requires only one component in the development material.

There is also known a method of developing electrostatic charge patterns employing an electroscopic toner particles suspended in a liquid system. With the proper choice of material, the toner, which is dispersed in a liquid, the toner becomes charged to a definite polarity. When the electrostatic charge pattern bearing member is brought into contact with the liquid suspension, the toner particles deposit where there is a preponderence of charge of the opposite polarity, as is the situation in cascade development.

Systems are also known where liquid developer materials are used instead of dry materials for the purpose of developing images, such as latent electrostatic images, and images or data and graphs produced by commercial printers and recorders. Liquid developer materials main disadvantage is that a solvent must be employed as part of the developer mixture, which solvent evaporates and causes undesirable odors, and possibly potential toxicity problems. In electrography, liquid ink techniques are utilized to develop electrostatic images produced by air ionization from writing nibs on dielectric coated paper.

There is thus a continuing need for toners suitable for use in one component conductive magnetic development systems and in particular toners which can be fused at relatively low fusing temperatures, referred to in the art as low melt toners, and which toners have adequate flow properties to render them highly useful for developing images in electrophotographic and printing machine systems.

SUMMARY OF THE INVENTION

It is an object of this invention to provide a dry single component toner composition which overcomes the above-noted disadvantages.

A further object of the present invention is the provision of a conductive single component magnetic dry toner which can be utilized to develop images without employing a carrier material.

Yet a further important object of the present invention is the provision of a conductive single component dry magnetic toner which finds utility in developing images formed by commercial printing machines, such as for example images generated by commercial printers and recorders such as the Versatec printers, including the Versatec 1200 printer.

An additional object of the present invention is the provision of a conductive single component dry magnetic toner which not only has excellent conductivity and excellent flow properties, but also has a low melt fusing temperature, that is, a temperature in the range of 95° C. to about 130° C.

It is a further object of the present invention to provide a single component magnetic toner which is magnetically manageable, of sufficient conductivity to render adequate developability for 100 volts electrostatic images, which toners contain sufficient magnetite so as to create retention forces sufficiently strong enough to allow a contamination free development system, and thus allow the production of high quality images with substantially no undesirable background.

These and other objects of the present invention are accomplished by providing a conductive single component magnetic dry toner comprised of resins selected from polystyrene allyl alcohol copolymers, and epoxy resins, a magnetic material such as magnetite, and a conductive carbon black which is adhered and/or embedded on the surface of the copolymer or epoxy resin-magnetic material mixture. This adherence can be accomplished by a number of known methods including heat spheroidization.

The resin component for the toner composition of the present invention is comprised of a copolymers of polystyrene and allyl alcohol, or epoxy resins, both of which are commercially available. Polystyrene, which is comprised of polymerized styrenes, can be described as a thermoplastic synthetic resin of variable molecular weight which depends on the degree of polymerization. For the purpose of the present invention useful polystyrene materials have a molecular weight of from about 3,000 to about 100,000 and preferably from about 8,000 to about 20,000. A preferred polystyrene is one that is commercially available from Hercules Corp.

The copolymer of polystyrene with the allyl alcohol can be prepared by a number of known methods including for example direct polymerization, by reacting the suitable polystyrene with allyl alcohol, in the presence of a polymerization initiator at a high temperature, however, such copolymers are also commercially available from Monsanto Corp. The copolymers generally used for the toners of the present invention contain at least 50 percent by weight of polystyrene, and preferably from about 50 percent to about 90 percent by weight of polystyrene, and from about 50 percent to about 10 percent of allyl alcohol. In one preferred embodiment of the present invention, there is employed as the copolymer resin a material containing 80 percent by weight of polystyrene and 20 percent by weight of allyl alcohol, as this composition when used as a developer material produces images of exceptional quality and excellent resolution.

Illustrative examples of epoxy resins useful in the present invention include various resins which are commercially available and identified for example as Shell EPON 1004, Shell EPON 1007, Shell EPON 1010, EPON 1002, and the like, commercially available from Shell Chemical Company.

The resin material, namely the copolymer of polystyrene and allyl alcohol or epoxy resin is present in an amount of from about 40 percent to about 60 percent by weight, and preferably from about 45 percent to about 55 percent by weight, the main function of said resin being to impart its low melt properties to the resulting toner resins, thereby rendering such resin fixable to paper at low temperatures of from about 90° C. to about 130° C., and preferably from about 90° C. to 110° C.

The magnetic material utilized with the above resins for causing the formation of the toners of the present invention can be comprised of numerous suitable particles which will produce desirable magnetic properties, such materials including for example ferrites, iron particles, nickel alloys, and preferably magnetites, such as Mapico black, a commercially available material, MO-4232, a magnetite commercially available from Pfizer Pigment Company, New York, New York, and K-378, a magnetite commercially available from Northern Pigments Corp., Toronto, Ontario, Canada. Mapico black is preferred since the particles are black in color, of low cost and provide excellent magnetic properties. The amount of magnetic pigment present ranges from about 40 weight percent to about 60 weight percent, and more preferably 50 percent by weight.

The toners of the present invention that is, the resin indicated together with the magnetic pigment, are magnetic in nature, in that they are attracted to a magnet but are not magnets themselves. Such toners can be held to a magnetic brush roller or belt by magnetic forces. The development field between the electrically connected magnetic brush and the receptor surface, induces a charge into the toner particles, opposite to the charge on the receptor. Subsequently the toner particles develop the electrostatic image, which can be present on the receptor surface.

One important feature of the composition of the present invention is the presence of a conductive carbon on the surface of the toner particles, comprised of the resin indicated and the magnetic material. The carbon black is adhered, and/or embedded into the surface of the toner particles, subsequent to the blending of the magnetic material with the resin.

It is only by adhering and/or embedding the carbon black particles into the toner particles that excellent print quality and free powder flow is obtained. By embedding is meant that the carbon black particles are firmly attached to the surface of the toner particles, thus, such particles do not dust, that is, freely migrate throughout the imaging device, or print out. It is also critical that the carbon black utilized be embedded on the surface of the toner particles in such a manner so as to provide the appropriate conductivity, as indicated herein to the toner particles. One method used for accomplishing this is by known heat spheroidization processes, for example as described in U.S. Pat. No. 3,639,245, the disclosure of which is totally incorporated herein by reference.

Suitable conductive carbon blacks that can be used in the present invention include Regal 330, Vulcan black, and the like. Vulcan carbon black which is preferred, is commercially available from Cities Service Company.

The conductive carbon black is present in an amount of from about 0.5 percent to about 4 percent. Preferably about 2 percent, of conductive carbon black is utilized.

The toners of the present invention generally have a resistivity that is dependent on the strength of the electric field, however, such toners are sufficiently conductive at typical development fields. A powder resistivity of at least $10^4$ to $10^{10}$ ohms-cm is preferred for the toners of the present invention. Such a resistivity allows excellent development especially when used in electrographic printing systems such as the commercial Versatec printers, where no electrostatic transfer is needed. The resistivity is equal to the reciprocal of the conductivity. Thus the conductivity of the toners of the present invention would range from $10^{-4}$ to $10^{-10}$ $(\text{ohm/cm})^{-1}$.

The toner particles of the present invention containing the conductive carbon black embedded therein are magnetically manageable, have adequate flow properties in order that they may be dispensed consistently from the toner dispenser, have sufficient conductivity to render adequate developability of electrostatic images, especially electrostatic images of 100 volts. Also, the developer mixture can be suitably colored, usually black, in order to allow the production of crisp dense images. Insofar as the fusing characteristics the compositions of the present invention have a low melt rheology, will not block, have excellent dielectric paper surface wetting under conditions that are inexpensive, and further, such toners do not produce electrographic paper damage.

Although it is not intended to be limited to a theoretical explanation, it is believed that the resins employed impart low melt characteristics to the resulting developing mixture, while the Mapico black renders the toner black in color, and magnetically manageable. The Vulcan carbon black and heat spheroidization step provides for toner conductivity, and in addition enhances free powder flow of the toner at levels which have minimum effect of polymer rheology.

The conductive toners of the present invention can be prepared by various known methods, such as melt blending with heated rolls followed by mechanical attrition, and heat spheroidization (U.S. Pat. No. 3,639,245 incorporated herein by reference). Also known spray drying processes can be employed for preparing the toners of the present invention. Subsequent to spray drying the toner is subjected to heat spheroidization as indicated herein. In one spray drying method the resin is dissolved in an organic solvent, or solvent mixture, like hexane-chloroform. The magnetic materials is also added to the solvent. Vigorous agitation such as that obtained by ball milling processes, assists in insuring good dispersion of the magnetic material. This solution is then pumped through an atomizing nozzle, while using an inert gas such as nitrogen as the atomizing agent. The solvent evaporates during atomization, resulting in toner particles, which are subjected to heat spheroidization with the conductive carbon black as described herein. Particle size of the resulting toner varies depending on the size of the nozzle, however, particles of a diameter of between about 0.1 microns and about 100 microns are generally obtained.

As indicated herein the toners of the present invention are particularly useful in printing and recording systems, such as electrostatic Plotters and Printers commercially available from Versatec. In one type of Versatec printing machine, programmed voltage is applied to an array of densely spaced writing nibs embedded in a stationary writing head. Upon digital commands the nibs selectively create electrostatic dots (a total of about 2112 dots across a 10.56 inch paper width) on an electrographic paper web passing over a writing head. The print speed is typically about 1000 lines per minute, and a typical paper speed for this machine is 1 inch per second.

In one method of operation electrostatic image voltage pulses are applied to the nib, and the back electrode. The electrographic paper is positioned between the nib and the electrode above certain threshold potentials, about 400 volts, air ionization occurs in a small air gap and charge migrates to the electrographic paper, such charge transfer being a function of the voltage, effective air gap, and the electrographic paper characteristics. It is this transferred charge which is developed with the single component conductive magnetic toner of the present invention.

The following examples are being supplied to further define the specifics of the present invention, it being noted that these examples are intended to illustrate and not limit the scope of the invention. Parts and percentages are by weight unless otherwise indicated.

EXAMPLE I

There was prepared by melt blending followed by mechanical attrition a toner composition containing 50 percent by weight of a copolymer of polystyrene and allyl alcohol, the percentage of polystyrene being 80 percent, and the percentage of allyl alcohol being 20 percent, which copolymer is commercially available from Monsanto Chemical Co., and as identified as RJ-100, and 50 percent by weight, 681 grams, of Mapico black, commercially available from Cities Service Co. Subsequently, there was added to the above mixture 2 percent by weight of a Vulcan conductive carbon black, commercially available from Cities Service Co., and identified as Vulcan 72R. The resulting mixture was then subjected to heat spheroidization utilizing the process as described in U.S. Pat. No. 3,639,245, at a temperature of 530° C., which heat spheroidization causes the Vulcan conductive carbon black particles to become embedded and permanently attached to the toner particle surfaces.

There resulted a single component conductive magnetic toner having a conductivity of $8\times10^{-7}$ $(\text{ohms/cm})^{-1}$, which toner when employed as a developing material in electrophotographic devices, electrostatic devices, or printing and plotting devices, commercially available from Versatec, produced developed images of high quality and excellent resolution. Complete fusing of the image was accomplished at 130° C., with no deterioration of the toner, no paper damage, nor any other adverse effects on the resulting images. Fusing at such low temperatures (95° C to 130° C), is very desirable especially since the machine components are less likely to be damaged and less energy is needed.

The procedure of Example I was repeated with the exception that the Vulcan carbon black and polystyrene allyl alcohol copolymer resin-Mapico black toner mixture was not heated spheroidized, resulting in a composition that did not contain the carbon black embedded in the toner surface. Such a toner when used to develop images in a Versatec printing device such as the Versatec printer 1200 produced images with very high background which is undesirable. Further, the images produced would not fuse well at a temperature of from 90° C. to 130° C.

EXAMPLE II

The procedure of Example I was repeated with the exception that 40 percent by weight of the polystyrene allyl alcohol copolymer resin was employed, and 60 percent by weight of Mapico black was utilized thereby resulting in a single component conductive magnetic toner having a conductivity of $6\times10^{-7}$ $(\text{ohm-cm})^{-1}$ that completely fuse at a temperature of 120° C. When the toner of this Example was employed as a developing material in electrophotographic devices, electrostatic devices, or printing and plotting devices commercially available from Versatec, there resulted developed images of high quality and excellent resolution with very low background.

EXAMPLE II

The procedure of Example I was repeated with the exception that the magnetite utilized was magnetite MO-4232, and substantially similar results were obtained as in Example I when the toner of this example was used to develop images in printing and plotting devices.

The toner of this example had a fusing temperature of about 115° C.

EXAMPLE IV

The procedure of Example I was repeated with the exception that 4 percent by weight of the Vulcan carbon black was used in place of the 2 percent by weight of Vulcan carbon black and substantially similar results were obtained as in Example I when the toner of this example was used to develop images in printing and plotting devices.

This toner had a fusing temperature of 119° C.

EXAMPLE V

The procedure of Example I was repeated with the exception that 2 parts by weight of Regal 330 carbon black was used in place of the two parts by weight of Vulcan carbon black and substantially similar results were obtained as in Example I when the toner of this example was used to develop images in printing and plotting devices.

This toner had a fusing temperature of 110° C.

EXAMPLE VI

The procedure of Example I was repeated with the exception that there was utilized 50 percent by weight of the epoxy resin Epon 1004, commercially available from Shell Chemical Co., in place of the copolymer of polystyrene and alloyl alcohol. There resulted a single component conductive magnetic toner having a conductivity of $5\times10^{8}$ (ohm-cm)$^{1}$ which when employed as the developing material in electrophotographic devices, electrostatic devices, or printing and plotting devices, commercially available from Versatec, produced developed images of high quality and excellent resolution. Complete fusing of the image was accomplished at 110° C. with no deterioration of toner, no paper damage, nor any other adverse effects on the resulting images.

EXAMPLE VII

The procedure of Example VI was repeated with the exception that the Vulcan carbon black and epoxy resins Mapico black toner mixture was not heat spheroidized, resulting in a material that did not contain the carbon black embedded in the toner surface. Such a toner when used to develop images in the Versatec printing device produced images with very high background, which is undesirable, and further the images produced would not fuse well at a temperature of from about 100° C. to 130° C.

EXAMPLE VIII

The procedure of Example VI was repeated with the exception that there was employed as the epoxy resin that resin identified as EPON 1007 commercially available from Shell Chemical Co., and substantially similar results were obtained as with the toner of Example VI when such a toner was used to produce images in printing and plotting devices.

Other modifications of the present invention will occur to those skilled in the art based upon a reading of the present disclosure. These are intended to be included within the scope of this invention.

What is claimed is:

1. A conductive single component magnetic dry toner composition comprised of from about 40 percent by weight to about 60 percent by weight of a polystyrene allyl alcohol copolymer resin, which resin is comprised of from about 50 percent to about 90 percent by weight of polystyrene, and from about 10 percent to about 50 percent by weight of allyl alcohol, and wherein the molecular weight of the polystyrene ranges from about 3,000 to about 100,000; and from about 60 percent by weight to about 40 percent by weight of a magnetic material, said toner composition further containing from about 0.5 percent to about 4 percent of a conductive carbon black which is adhered to or embedded in the surface of the polystyrene allyl alcohol copolymer resin magnetic mixture by heat spheroidization, thereby resulting in a toner composition having a conductivity of from $10^{-4}$ to $10^{-10}$ (ohms/cm)$^{-1}$, and a fusing temperature of from about 95° C. to about 130° C.

2. A conductive single component magnetic toner in accordance with claim 1 wherein the magnetic material is Mapico black.

3. A conductive magnetic dry toner composition in accordance with claim 1 wherein the polystyrene allyl alcohol copolymer, which consists of 80 percent of styrene and 20 percent of allyl alcohol is present in an amount of 48 percent by weight, the magnetic pigment is present in an amount of 50 percent by weight, and the conductive carbon black is present in an amount of 2 percent by weight, resulting in a toner composition which has a conductivity of $8\times10^{-7}$ (ohms/cm)$^{-1}$, and a fusing temperature of 130° C.

* * * * *